US006935722B2

(12) United States Patent
Tunnicliffe-Wilson

(10) Patent No.: US 6,935,722 B2
(45) Date of Patent: Aug. 30, 2005

(54) TIMER DEVICE FOR A DIGITAL PRINTER AND METHOD OF PRINTING

(75) Inventor: Stephen George Tunnicliffe-Wilson, Cambridge (GB)

(73) Assignee: INCA Digital Printers Limited, Cambridge (GB)

( * ) Notice: Subject to any disclaimer, the term of this patent is extended or adjusted under 35 U.S.C. 154(b) by 96 days.

(21) Appl. No.: 10/343,534

(22) PCT Filed: Aug. 1, 2001

(86) PCT No.: PCT/GB01/03460

§ 371 (c)(1),
(2), (4) Date: Apr. 7, 2003

(87) PCT Pub. No.: WO02/09947

PCT Pub. Date: Feb. 7, 2002

(65) Prior Publication Data

US 2003/0156496 A1 Aug. 21, 2003

(30) Foreign Application Priority Data

Aug. 1, 2000 (GB) ..... 0018858
Aug. 7, 2000 (GB) ..... 0019364

(51) Int. Cl.[7] ..... B41J 23/00; B41J 21/16
(52) U.S. Cl. ..... 347/37; 400/279
(58) Field of Search ..... 347/14, 19, 37; 400/279, 74

(56) References Cited

U.S. PATENT DOCUMENTS 4,037,230 A 7/1977 Fujimoto et al.
4,524,364 A 6/1985 Bain et al.
5,116,150 A 5/1992 Courtney
5,499,093 A 3/1996 Aerens et al.
5,539,433 A 7/1996 Kawai et al.
5,600,352 A 2/1997 Knierim et al.
5,819,649 A * 10/1998 Townsend et al. ..... 101/93.01
5,873,663 A 2/1999 Yokoi et al.
5,889,534 A 3/1999 Johnson et al.
6,354,691 B1 * 3/2002 Uchikata ..... 347/37

FOREIGN PATENT DOCUMENTS

EP 0392702 10/1990
JP 2000289253 10/2000

* cited by examiner

*Primary Examiner*—Stephen D. Meier
*Assistant Examiner*—Alfred Dudding
(74) *Attorney, Agent, or Firm*—Venable LLP; Robert Kinberg

(57) ABSTRACT

A digital printer has a printhead (10) for printing on a substrate and an encoder (14) which emits pulses (122) to indicate the relative distance moved by the printhead. A timer device for the digital printer emits output print pulses (151) for effecting printing and a count module (130) for receiving pulses (122) from the encoder (14) and emitting a print signal after a predetermined number of encoder pulses (122) to effect the emission of the output print pulse. The timer device is adapted to add a delay between the emission of the print signal and the emission of the output print pulse (151). In examples described, the pitch of the printed droplets can be closely controlled.

29 Claims, 3 Drawing Sheets

TIMER DEVICE FOR A DIGITAL PRINTER AND METHOD OF PRINTING

The present invention relates to digital printing. In particular, the invention relates to a timer device for use in a digital printer to a digital printer incorporating the timer device and to a method of printing. The invention finds particular application for use with inkjet printers, and lends itself particularly to piezo actuated drop-on-demand printers, but is generally applicable to all types of digital printers.

In known digital printers the operation of a printhead to effect printing is carried out using electrical pulses. For example, in inkjet printers, electrical pulses are used to cause the printhead to emit droplets of ink towards the substrate to be printed.

In digital printing, the image to be printed is usually processed to create a print grid which indicates, for the example of inkjet printing, where the droplets of ink are to be deposited by the printhead to create the image.

A digital inkjet printer has a printhead having an ink supply and nozzles for emitting the droplets of ink. The printhead is arranged to move relative to the substrate. The emission of the ink droplets is timed in dependence on the relative position so that the ink droplets are deposited in the correct place on the substrate according to the print grid. The printer includes control unit for coupling the mechanical movement of the printhead and/or the substrate to the deposition of the ink droplets. The control unit includes a timer device for timing the sending of electrical signals to the printhead to effect the emission of the ink droplets.

It is clearly important that the ink droplets are deposited in the correct place on the substrate to give a true image. In a first type of printer, the control unit determines the mechanical movement of the printhead and/or substrate using an encoder which indicates the relative distance moved by the printhead over the substrate. This can be done using a shaft encoder (which measures the rotation of the shaft driving the printhead and/or the substrate) or a linear encoder (which measures the linear movement of the printhead and/or substrate). The encoder emits pulses which correspond to the relative distance moved and which are passed to the timer device which gives the signals to effect the release of the droplets of ink at the appropriate time.

The timer device translates the encoder signals into signals emitted to effect the printing of the droplets. For example, where the encoder gives a pulse every 10 $\mu$m of movement of the printhead, and the droplets are to be deposited 70 $\mu$m apart, the timer device is arranged to emit the printing signals after every 7 pulses received from the encoder.

Every encoder has a particular resolution which determines how often pulses are emitted as the printhead moves relative to the substrate. An encoder having an appropriate resolution is chosen depending on the required distance between the droplets (the droplet pitch): the resolution will usually be a factor of this distance.

Thus, where the droplet pitch is to be 70 $\mu$m, the encoder resolution is conveniently chosen as 10 $\mu$m. However, images are usually processed on the basis of "dpi" (dots per inch). A 360 dpi image requires a droplet pitch which is slightly greater than 70 $\mu$m (approximately 70.56 $\mu$m). Furthermore, encoders having appropriate non-integer resolutions are not easily available.

Therefore, using readily available encoders, it is often not possible to obtain the correct image size. If a "360 dpi" image were printed using a 10 $\mu$m encoder using the above described method, the droplets would be deposited 70 $\mu$m apart and each droplet will be deposited in slightly the wrong place, the error accumulates and an image of about 363 dpi will be printed. Thus where an encoder is used having the "wrong" resolution, the printed the image will be slightly smaller or larger than desired. On a large image, the resulting distortion of the image may be particularly noticeable.

It is difficult to make fine adjustments to the encoder to change its resolution to give a non-integer distance between pulses. Thus there are problems in using metric encoders to print images which have been processed using non-metric units.

One possible solution could be to redesign the image to be printed so that, when printed with the "wrong" encoder, the image will be true. However, it is thought that that would not be an attractive solution. For example, image processing packages currently available are generally based on dpi and assume that the dpi of the image is the same both parallel and perpendicular to the printing direction. Printheads generally have a nozzle pitch being based on an integer dpi value, for example 360 dpi. Thus, while an image could, in theory, be processed having a resolution of 362.9 dpi×362.9 dpi, standard printheads could then not be used if the image is to be true both parallel and perpendicular to the print direction.

It has been suggested that the mechanics of the printer could be arranged so that the error in the droplet placement is reduced, or a special encoder could be made having exactly the correct resolution. Neither solution appears particularly attractive.

In particular, where the printer is to be used in an environment in which the conditions, for example temperature, are not constant, it would be desirable to be able to make fine adjustments to the printing parameters, for example to allow for any slight expansion of the substrate. Where the printer has been specially adapted and/or a special encoder has been made for a particular printing task, it will generally have fixed parameters which could not be adjusted to account for any variations due to, for example, temperature fluctuations.

It would be desirable to provide a timer device and/or printer control unit which overcame or at least mitigated one or more of the above problems.

An alternative method is the "Phased Locked Loop". According to that method, the speed of the printhead relative to the substrate is relatively stable and a printing frequency is derived to obtain the desired printing pitch. This solution is thought not to be ideal in that the speed of the printhead relative to the substrate must be approximately constant for correct printing. If there is a significant variation in the speed during printing, the printed area can exhibit wavy lines. Where a first printing pass produces a wavy line and the next pass is correct, the wavy printing can be highlighted. However, on average, the printing using the Phased Locked Loop method can be found to give the correct size image. Thus the Phase Locked Loop method can, in some circumstances, achieve an accurate non-integer divide ratio so that a "metric" encoder can be used to give the correct size dpi image. However, the Phased Locked Loop method has been found to be less satisfactory for use over a wide range of printing speeds (for example 2:1), does not work well at low speeds and will not track changes in the relative speeds (the shaft encoder frequency) very quickly.

According to the present invention there is provided a timer device for a digital printer having a printhead for printing on a substrate, the printhead being movable relative to the substrate, and an encoder arranged to emit pulses to indicate the distance moved by the printhead relative to the substrate, the timer device comprising:

means for emitting output print pulses for effecting printing;

a count module for receiving pulses from the encoder and emitting a print signal after a predetermined number of encoder pulses the print signal effecting the emission of the output print pulse; and a delay means for adding a delay between the emission of the print signal and the emission of the output print pulse.

By providing a delay means for delaying the emission of the output print pulse, the timing between the output print pulses can be varied. The delay means, means for emitting output print pulses and the count module all preferably comprise electronic components. Thus the "wrong" encoder can be used to generate the print pulses, the error in the positioning of the print being correctable or reduced by adding the delay. In its simplest aspect, the invention provides a mechanism for varying the time between the output print signals.

Preferably, the delay means is adapted to add the delay periodically. Thus the "error" arising from the use of the "wrong" encoder can be allowed to accumulate for a certain printing distance, the error being corrected or reduced periodically. By this method, the error can be made so as it never becomes so much as to significantly reduce the quality of the finished print.

Preferably, the count module includes a counter for counting a predetermined number of encoder pulses and means for loading a predetermined number into counter. It will be understood that the number loaded into the counter may or may not be numerically equal to the number of encoder pulses. The counter is preferably a down counter into which the predetermined number is loaded, the counter counting down from the predetermined number on receiving the pulses from the encoder, the count module giving a print signal when the counter reaches a predetermined number, for example zero. Other counter devices could be used. For example, an up counter could be used, the counter module giving the print signal when the counter reaches the predetermined number.

Preferably, the device further includes means for determining the predetermined number. Preferably, the means for determining the predetermined number comprises a processor, preferably for determining the divide ratio. Preferably, the predetermined number is the integer part of the divide ratio. The value of the divide ratio for the encoder as used herein is given by the pitch of the dots to be printed divided by the resolution of the encoder. For example, where the pitch of the dots to be printed is 70 $\mu$m and the resolution of the encoder is 10 $\mu$m, the divide ratio of the encoder is 7. In this case, the predetermined number is 7 and the counter gives the print signal after counting 7 encoder pulses. Where the image to be printed is 360 dpi, the desired pitch of the dots to be printed is about 70.56 $\mu$m and the divide ratio is about 7.056. In that case, the predetermined number is 7.

Preferably, the delay means is adapted to add a delay equivalent to one encoder pulse cycle. In the example given above, it will be seen that where the predetermined number is 7 for a 360 dpi image, an error of 0.56 $\mu$m will accumulate for each dot printed. This error is preferably adjusted for periodically by delaying the printing of a dot by an extra encoder pulse, which will be equivalent to 10 $\mu$m for the above example.

Preferably, the delay means includes means for receiving the encoder pulses, and means for emitting a delay signal to a delay adder after a number of encoder pulses have been received. When the delay signal has been received, the delay adder preferably adds a delay to the next output print pulse. Thus preferably the timing of the delay also depends on the receiving of the encoder pulses and thus on the relative distance moved by the substrate and printhead. In this way, the method can be made independent of the relative speed of movement of the substrate and the printhead (unlike the phase locked loop method described above). The method of the present invention can therefore be used at a wide range of different speeds and where the speed of the substrate relative to the printhead varies. Indeed, because the printing of the dots and the adding of the delay both preferably depend on the receiving of encoder pulses and thus the absolute distance moved by the substrate relative to the printhead, it is possible to stop the movement during a print run and restart without disturbing the printing, or the error correction mechanism provided by the delay.

Preferably, the delay means includes an accumulation register and, in use, a delay number is added to the accumulation register on receipt of an encoder pulse, and means for determining when the accumulation register reaches a threshold value, and means for adding a delay to the next output signal when the threshold value is reached. Thus at each encoder pulse, the delay number is added to the register. Once the threshold is reached, a signal is preferably sent to a module, the delay adder, which acts to add a delay to the next output print pulse. The threshold is preferably set so that the delay is sufficiently frequent that the error in the dot placement does not get too great. Once the threshold has been reached and the delay signal sent, preferably any remainder is kept in the register. For example, if the series of register values is 0.896, 0.952, 1.008, the delay signal is sent once the register value is 1.008, but preferably the register is not then reset to zero but the 0.008 is retained. Thus greater accuracy of printing can be achieved.

Preferably, the delay number corresponds to the fractional remainder of the divide ratio. Thus the frequency of addition of the delay is directly related to the size of the error. In effect the method uses a modified fixed divide method in which a non-integer divisor is used; the integer divisor being used as the predetermined number, and the fractional remainder being used to correct errors arising from using only the integer divisor. For example, where the divide ratio is 7.056 (for a 10 $\mu$m encoder printing a 360 dpi image), the delay number is 0.056. It will be understood that where the fractional remainder includes several significant figures, only one, two or three significant figures will usually be used for the delay number, unless greater accuracy is required. The number of significant figures used will usually be in proportion to the accuracy required.

Preferably, the threshold value is one. Thus the printer preferably prints using only the predetermined number until the accumulated error reaches the equivalent of a whole encoder pulse. The next dot printed is then an extra encoder pulse distant from the previous one, reducing or eliminating the accumulated error. Thus the maximum error in the dot placement is one encoder pulse which, for a 10 $\mu$m encoder corresponds to −10 $\mu$m. In an alternative embodiment, the threshold is 0.5. In this embodiment, when the error is equivalent to half an encoder pulse, the next dot printed is an extra encoder pulse distant from the previous one. In this case, the maximum error in the dot placement is ±5 $\mu$m. It will be understood that other threshold values could be chosen.

In embodiments of the present invention, the predetermined number, the frequency of adding the delay and/or the delay number is preferably programmable. Thus it is possible to control the printing of the dots and to make fine adjustments, for example in view of varying ambient conditions. In a preferred embodiment of the invention, the delay number is programmable and/or adjustable so that very fine adjustments can be made to the print pitch, for example for temperature compensation.

The invention further provides a control unit for controlling a digital printer, the control unit including a timer device as described above.

Preferably the control unit further includes means for determining the predetermined number and the delay number. Preferably, the means for determining the predetermined number and the delay number comprises a processor for determining the divide ratio.

Preferably the control unit further includes an encoder. In preferred embodiments of the invention the encoder is a shaft encoder, but other encoders, for example a linear encoder, could be used.

Preferably, the control unit further includes a product detector. The product detector preferably includes an electronic component for detecting the presence of the substrate. Once the substrate is detected, preferably the timer device is reset, for example by resetting to zero the counters and the accumulator register.

According to the invention, there is also provided a digital printer including a timer device as described above and/or a control unit as described above.

According to the invention, there is also provided a method of digital printing a substrate using a printhead, the method comprising:

moving the printhead relative to the substrate;

arranging an encoder to emit pulses to indicate the distance moved by the printhead relative to the substrate;

counting pulses emitted by the encoder and emitting a print signal after a predetermined number of encoder pulses, the print signal effecting the emission of an output print pulse for effecting printing, and periodically delaying the emission of the output print pulse after emission of the print signal.

Preferably the method further includes the step of determining the predetermined number. As described above, the predetermined number is preferably calculated as the integer part of the divide ratio.

Preferably, the delay is equivalent to one encoder cycle.

Preferably, the method includes the step of adding a delay number to an accumulation register on receiving each encoder pulse, the delay being added to the next output signal when the accumulation register reaches a threshold value.

Preferably the delay number corresponds to the fractional remainder of the divide ratio.

In a preferred embodiment of the invention, the threshold value is one.

In an embodiment of the invention, the method further includes the step of setting the predetermined number. Preferably, the method further includes the step of setting the delay number.

Preferably the method further includes the step of detecting the substrate and resetting the accumulation register when the substrate is detected. Preferably, any counters in the timer device are also reset.

The invention also provides a digital printer controlled by a method as described above and a printed substrate printed using a method as described above.

The various features of the apparatus are preferably provided by electronic devices. That term is to be interpreted broadly to cover a wide range arrangements of devices and circuits including, but not restricted to integrated circuits, transistors, valves, resistors or capacitors or combinations thereof.

One or more features of the apparatus may be embodied in computer software. Thus the apparatus may comprise a suitably programmed processor to provide one or more features of the apparatus. Some or all of the features of the timer device may comprise a suitably programmed processor.

The invention also provides a computer program and a computer program product for carrying out any of the methods described herein, and a computer readable medium having stored thereon a program for carrying out any of the methods described herein.

Apparatus features may be applied to the method features and vice versa.

Embodiments of the invention will now be described, purely by way of example, with reference to the accompanying drawings, in which.

Figure 1:
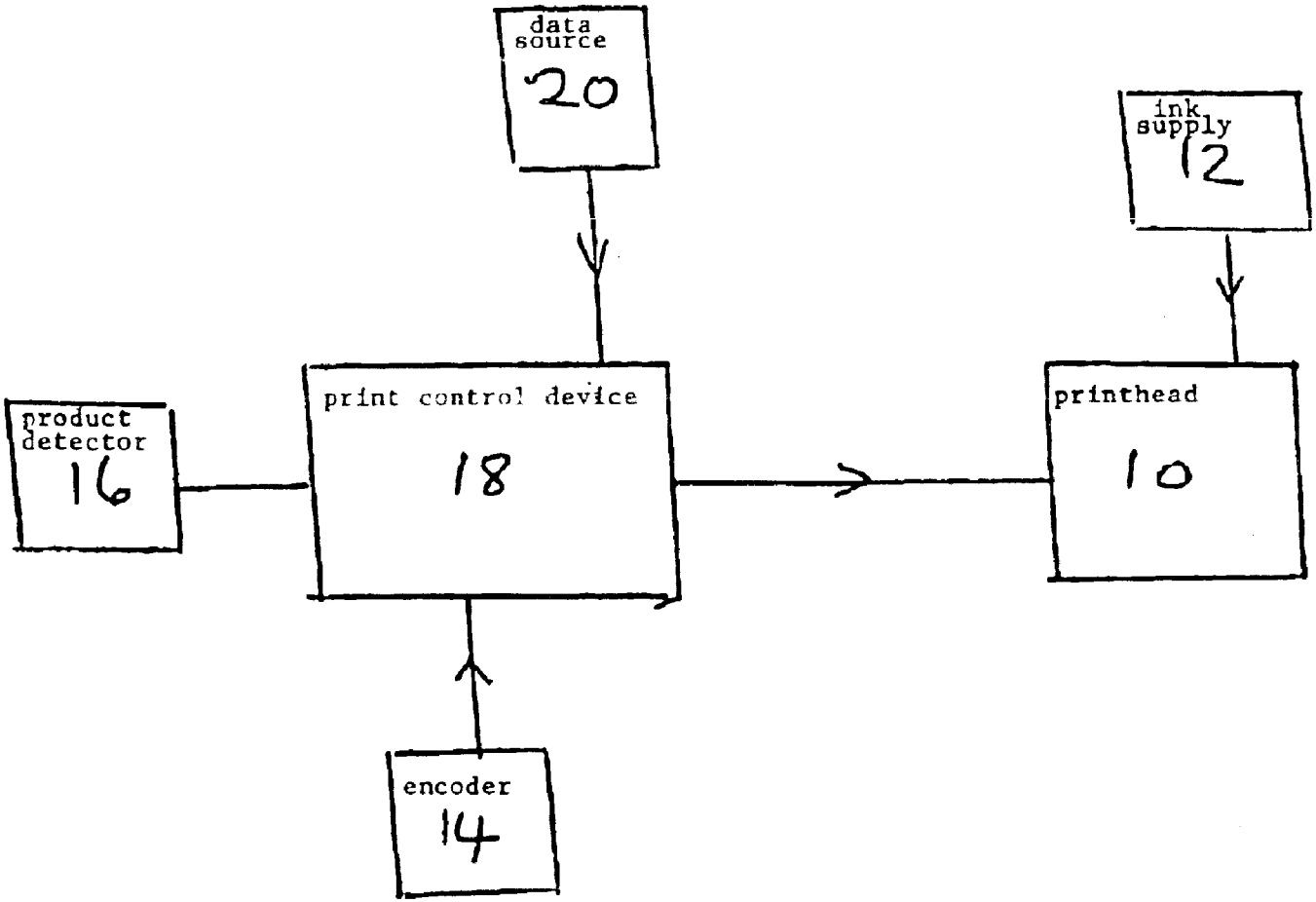
FIG. 1 shows a block diagram of a digital printer.

FIG. 1 shows a simplified block diagram of part of the printing apparatus of a digital printer. The printer includes a printhead 10 having an ink supply 12. The printer further includes an encoder 14 for determining the distance moved by the printhead 10 relative to the substrate and a product detector 16 for detecting the presence of the substrate to be printed. The printer includes a print control device 18 which receives signals from the encoder 14 and the product detector 16 as well as a data source 20 which provides information about the image to be printed. The print control device 18 sends signals to the printhead 10 to effect printing of the substrate.

Figure 2:
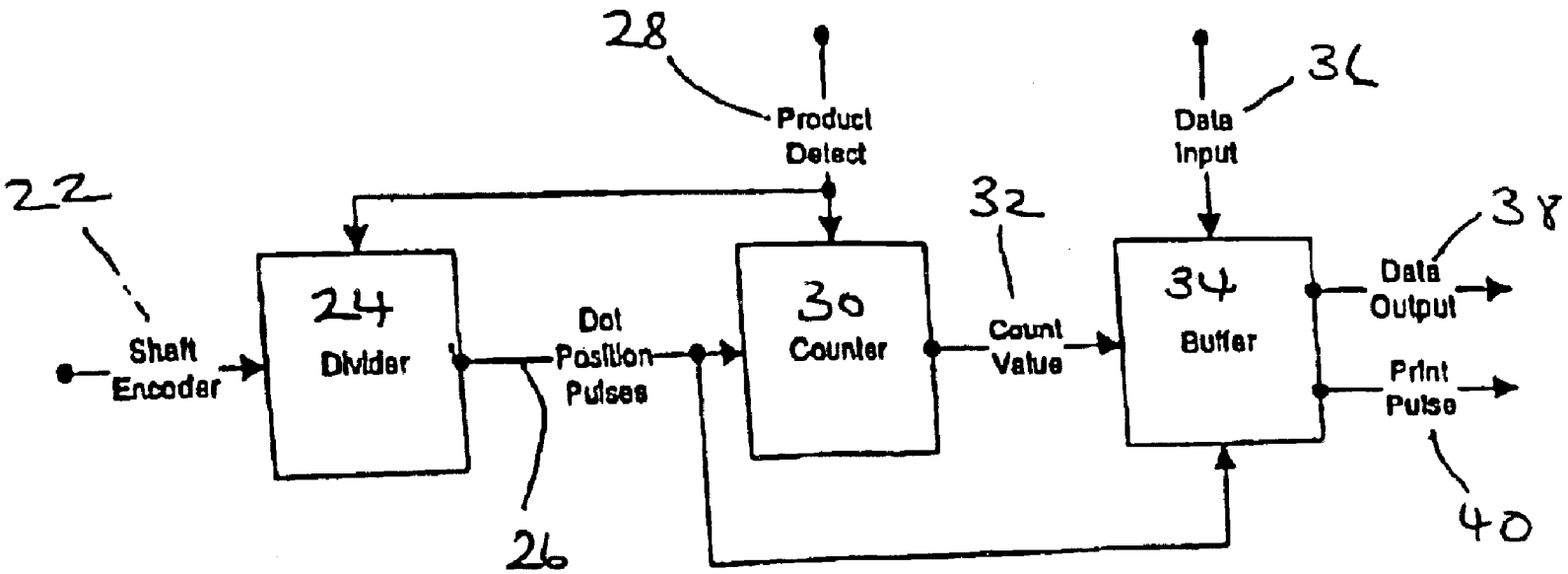
FIG. 2 shows a block diagram of a print control unit of a digital printer.

FIG. 2 shows a block diagram of the basic modules of a print control device 18. The shaft encoder 14 provides a signal 22 comprising pulses corresponding to equally spaced positions of the printing substrate relative to the printheads 10. A divider module 24 converts the encoder pulses into a sequence of dot position pulses 26. The timing of the dot position pulses 26 depends on the spacing of the encoder pulses 22 and the pitch of the dots to be printed. For example, if the pitch of the dots to be printed is 70 $\mu$m and the spacing of the encoder pulses corresponds to 10 $\mu$m, the divider 24 emits a dot position pulse 26 after every 7 encoder pulses 22 received.

The product detector 16 provides a product detect signal 28 whenever a new product (substrate) approaches the printing heads. The product detect signal 28 causes the divider 24 to reset, aligning the dot position pulses 26 with the position of the substrate.

The counter module 30 counts the dot position pulses 26. The count module 30 and hence the count value is also reset (to zero) by the product detect signal 28. Thus the counter 30 holds the number of dot positions since the product detect signal was activated.

The count value 32 of the counter 30 is sent to a buffer 34 and the buffer 34 uses the count value 32 to select the correct data for printing from the data input 36. The buffer 34 also uses the dot position pulses 26 to time the data fed to the data output. A print pulse 40 is also generated to activate the printing. The data output 38 and the print pulse 40 are sent to the digital print heads 10.

Thus, in its simple form, the print control device 18 provides an integer value for the spacing of the dot position pulses 26 based on the shaft encoder pulses 22 and the divider 24. Thus the dot position spacing is an integer multiple of the encoder resolution and, as described above, if that is slightly different from the desired dot pitch, the image will not be true.

Figure 3:
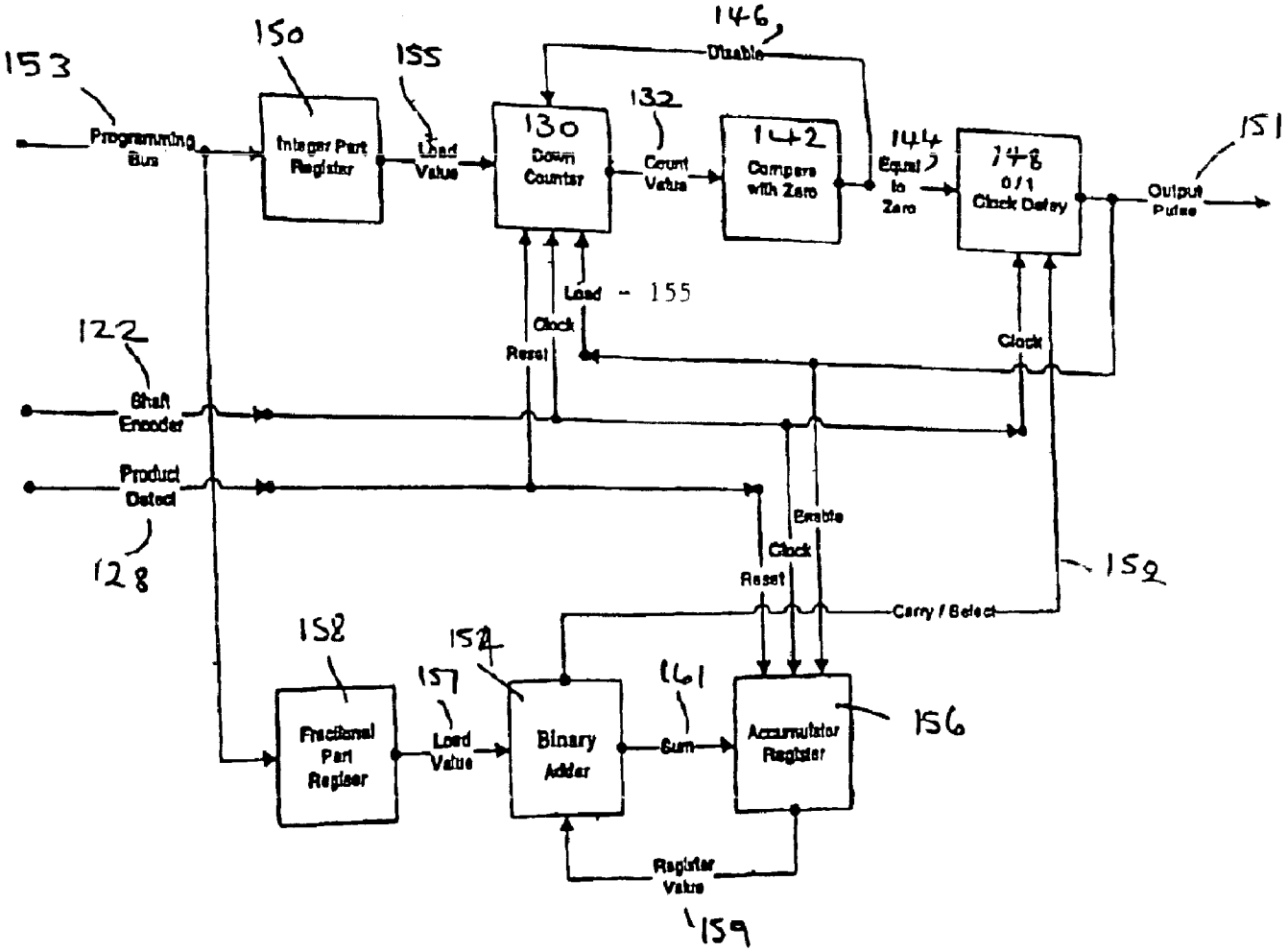
FIG. 3 shows a block diagram of a part of a print control unit of a digital printer.

FIG. 3 shows a timer device which seeks to allow for the discrepancy between the encoder resolution multiple and the desired printing pitch.

The timer device includes a down counter 130 and a product detect signal 128 is used to reset (to zero) the counter 130. The count value 132 of the down counter 130 is sent to a "compare with zero" module 142. When the count value 132 is equal to zero 144, the "compare with zero" module 142 causes the down counter 130 to disable 146, preventing wrap-around. The equal to zero signal 144 is sent to a "0/1 clock delay" module 148 which may include a delay, following which the down counter 130 is loaded 155 with a load value equal to the integer part register 150 minus 1. Following the delay, if any, the output pulse 151 is sent to the printheads 10.

In the first cycle of the print control unit, the delay is a zero number of shaft encoder cycles (asynchronous) when the carry output 152 of the binary adder 154 is inactive (see below).

The programming bus 153 is used to load a predetermined number into the integer part register 150 and the delay number into the fractional part register 158. The printer includes a processor (not shown) which determines the divide ratio for the encoder used and the image to be printed. The integer part of the divide ratio is loaded into the integer part register 150 for loading 155 the load value into the down counter 130; the fractional part is loaded into the fractional part register 158 for loading 157 into the binary adder 154.

The product detect signal 128 also resets an Accumulator Register 156 to zero. On every cycle of the shaft encoder, that is at every shaft encoder pulse 122, the accumulator register adds the value of the fractional part register 158 to itself At each encoder pulse received by the accumulator register 156, the register value 159 is loaded into the binary adder 154 which also holds the value of the fractional part register 158. The register value is summed with the delay number and the sum is returned 161 to the accumulator register 156. When the addition reaches an overflow value, which here is 1, the binary Adder 154 carry output 152 selects a 1 Clock Delay from the "0/1. Clock Delay" module 148. When the down counter 130 next reaches zero, there will be an extra shaft encoder cycle delay before it is reloaded. This also causes the output pulse 151 to be delayed by one shaft encoder cycle.

The rate at which the binary Adder 154 overflows is determined by the fractional part register 158. By setting this to the divide ratio bit value below the decimal point, the output pulse 151 will dither between a count of (integer part) cycles of the shaft encoder and (integer part +1). The average divide ratio will hence be the combination of the integer part and fractional parts as a fixed point number.

For example, a 360 dpi image is to be printed using a shaft encoder 14 having a resolution of 10 $\mu$m; the dot pitch for achieving the required 360 dpi image is 70.56 $\mu$m. A divider module determines that for the correct position of the dots, a print pulse should be printed corresponding to every 7.056 encoder pulses; this is the divide ratio. The integer part of the divide ratio (7) is loaded into the integer part register 150; the "remainder" of the divide ratio, corresponding to 0.056, is loaded into the fractional part register 158. (In the present example, two significant figures are used (giving 1% accuracy).)

The product approaches the print heads 10 and the product detector 16 sends the product detect signal 128. This resets (to zero) the down counter 130 and the accumulator register 156. The count value of the counter 132 is sent to the compare with zero module 142, the count value 132 is equal to zero and so the down counter is disabled 146. The equal to zero signal is passed to the "0/1 Clock Delay" module 148, the delay is zero and the output pulse 151 is emitted to a buffer 34. The buffer 34 selects the correct data for printing from the data input 36; a print pulse and the data output are emitted by the buffer 34. In this example, a single output pulse 151 is used to generate a sequence of data output from the buffer, followed by a print pulse. The sequence of data and print pulses will depend on the model of printhead(s) used.

The value of the integer part register 150 (the integer value 7 in this example) minus 1 is then loaded into the down counter 130. As pulses are received at the down counter 130 from the shaft encoder, the down counter counts down from 6 to zero; while the count value is greater than zero, no output pulse 151 is emitted. When it reaches zero, as described above, an output pulse is emitted after a delay introduced by the "0/1 Clock Delay" module 148. The delay added in this example is either zero encoder pulses (no delay) or one encoder pulse.

The encoder pulse 122 is also fed to the accumulator register which causes the value of the fractional part register (0.056) to be added to the accumulator register 156. The value of the accumulator register 156 is passed to the binary adder 154. When the value of the sum becomes greater than one, a carry/select signal 152 is sent to the "0/1 Clock Delay" 148 which causes the clock to register a delay of one encoder pulse for the next output signal. The register value in the accumulator register is effectively the remainder from 1 of the register value and the addition of the fractional part register 158 begins again at the next shaft encoder pulse 122. In this example, the accumulator register effectively holds only three digits.

In an alternative example, the threshold of the accumulator register is 0.5. In this case, the carry/select signal is generated when the register value is less than 0.5 and the sum is greater than or equal to 0.5. In this example, the accumulator and adder could be operated as for the case where the accumulator threshold were 1.0.

On the next occasion when the count value 132 is zero, the "0/1 Clock Delay" 148 adds a delay of one shaft encoder pulse before the output pulse 151 is emitted. Thus the time between that output pulse and the previous output pulse is 8 encoder pulses, rather than 7.

Thus, for the present example, the output pulses will be generally 7 encoder pulses apart, but periodically the time between output pulses will be 8 encoder pulses to account for the discrepancy between the multiple of the encoder resolution and the desired dot pitch. In the example given, the delay will be added every 17 or 18 output pulses. The first dot printed will be in exactly the correct place. The next dot will be printed 70 $\mu$m away from the first dot, about 0.056 $\mu$m too close to the first dot, and so on, each subsequent dot being printed too close to the previous one, increasing the "error" in the distance from the first dot. After 17 or 18 printed dots, the next dot is printed after a delay of an extra encoder pulse, thus placing the next dot 80 $\mu$m from the previous one and making up some (or all) of the error compounded over the previous 17 or 18 dots.

Thus, while there remains a local "error" in the placement of the dots, the error is corrected every few dots, so that the overall image quality is good and the size of the image is correct. For a the encoder used in the example having a resolution of 10 $\mu$m, the local "error" in the dot placement may be up to −10 $\mu$m.

A smaller "error" may be achieved if an encoder having a smaller resolution were used. For example, for a 1 μm encoder, the maximum "error" in the dot placement would be only −1 μm. The encoder would be chosen so that one pitch of the encoder was acceptable as an error in the printed image.

In an alternative arrangement, the carry/select signal 152 could be emitted when the register value of the accumulator register 156 reached 0.5. In this way, using a 10 μm encoder, the maximum "error" in the dot placement would be ±5 μm, thus increasing the quality of the image compared with the case in which threshold for the signal to be emitted is 1. It will be understood to the skilled man that other threshold values could be used.

In other examples, the number of encoder pulses could periodically be reduced to compensate for the "error" in the dot placement.

In the example described above, the divide ratio alone is used to generate the integer part and the fractional part which are constant for a given encoder. In an alternative example, the integer part and the fractional part are programmable so that alterations can be made to the printing pitch, for example to take account of changing ambient conditions.

Since the printed image is the correct size, the quality of the printed image is improved and colour images can be printed more accurately. For more accurate line up of the printing, in particular colours of colour images, the product detect pulse is preferably synchronised with the shaft encoder pulses.

As can be seen, aspects of the invention allow for adjusting the overall firing frequency of the printheads or the resolution of the printed image, thus changing the overall print scale. Thus, it is possible to compensate for differences between the image resolution and the encoder resolution.

It will be understood that different arrangements of components could be used to achieve the benefit of the invention. For example, instead of a down counter 130, an up counter could be used with consequential changes to other components, for example the compare with zero module 142. In other examples, the "compare with zero" module 142 could be a "compare with one" module, in which case the loaded value 155 could be the value of the integer part register 150. A different adder could be used instead of the binary adder 154, with consequential changes to the other components, where necessary.

It will be understood that the embodiments of the present invention described above are purely examples, and modifications of detail can be made within the scope of the invention.

Each feature disclosed in the description, and (where appropriate) the claims and drawings may be provided independently or in any appropriate combination.

What is claimed is:

1. Timer device for a digital printer having a printhead for printing on a substrate, the printhead being movable relative to the substrate, and an encoder arranged to emit pulses to indicate the relative distance moved by the printhead relative to the substrate, the timer device comprising:

means for emitting output print pulses for effecting printing;

a count module for receiving pulses from the encoder and emitting a print signal after a predetermined number of encoder pulses, the print signal effecting the emission of the output print pulse; and a delay means for adding a delay between the emission of the print signal and the emission of the output print pulse to adjust the average number of encoder pulses corresponding to a plurality of output print pulses.

2. A timer device according to claim 1, wherein the delay means is adapted to add the delay periodically.

3. A timer device according to claim 2, wherein the delay means includes means for receiving the encoder pulses, and means for emitting a delay signal to a delay adder after a number of encoder pulses have been received.

4. A timer according to claim 3, wherein the delay means includes an accumulation register and, in use, a delay number is added to the accumulation register on receipt of an encoder pulse, and means for determining when the accumulation register reaches a threshold value, and means for adding a delay to the next output signal when the threshold value is reached.

5. A timer according to claim 4, wherein the delay number corresponds to the fractional remainder of the divide ratio.

6. A timer according to claim 4, wherein the threshold value is one.

7. A timer according to claim 1, wherein the count module includes a counter for counting the predetermined number of encoder pulses and means for loading a predetermined number into the counter.

8. A timer device according to claim 1, wherein the device further includes means for determining the predetermined number.

9. A timer device according to claim 8, wherein the means for determining the predetermined number includes means for determining the divide ratio.

10. A timer device according to claim 1, wherein the delay means is adapted to add a delay equivalent to one encoder pulse cycle.

11. A timer according to claim 1, wherein the predetermined number is programmable.

12. A timer according to claim 1, wherein the frequency of adding the delay is programmable.

13. A timer according to claim 4, wherein the delay number is programmable.

14. A control unit for controlling a digital printer, the control unit including a timer device according to claim 1.

15. A control unit according to claim 14, further including means for determining the predetermined number and the delay number.

16. A control unit according to claim 15, further including an encoder.

17. A control unit according to claim 15, further including a product detector.

18. A timer according to claim 1, wherein said delay means controls loading of the count module.

19. A method of digital printing a substrate using a printhead, the method comprising:

moving the printhead relative to the substrate;

arranging an encoder to emit pulses to indicate the relative distance moved by the printhead relative to the substrate;

counting pulses emitted by the encoder and emitting a print signal after a predetermined number of encoder pulses, the print signal effecting the emission of an output print pulse for effecting printing, and periodically delaying the emission of the output print pulse after emission of the print signal to adjust the average number of encoder pulses corresponding to a plurality of output print pulses.

20. A method according to claim 19, further including the step of determining the predetermined number.

21. A method according to claim 19, wherein the delay is equivalent to one encoder cycle.

22. A method according to claims 19, wherein the method includes the step of adding a delay number to an accumulation register on receiving each encoder pulse, the delay being added to the next output signal when the accumulation register reaches a threshold value.

23. A method according to claim 22, wherein the delay number corresponds to the fractional remainder of the divide ratio.

24. A method according to claim 22, wherein the threshold value is one.

25. A method according to claim 19, including the step of setting the predetermined number.

26. A method according to claim 19, including the step of setting the delay number.

27. A method according to claim 19, further including the step of detecting the substrate and resetting the accumulation register when the substrate is detected.

28. A computer readable medium having stored thereon a program for carrying out a method according to claim 19.

29. A timer device for a digital printer having a printhead movable relative to a substrate for printing dots having a predetermined pitch on the substrate, and an encoder having a predetermined resolution for emitting pulses corresponding to the distance moved by the printhead relative to the substrate, a divide ratio having an integer part and a fractional part being determined by dividing the pitch of the dots to be printed by the resolution of the encoder, comprising:

means for emitting output print pulses to the printer;

count means for receiving pulses from the encoder and for emitting a signal after a predetermined number of encoder pulses, the print signal effecting emission of the output print pulses; and delay means for adding a delay between the emission of the print signal and the emission of the output print pulse, said additional delay being added when the fractional part of the divide ratio multiplied by the number of encoder pulses generated after printing of a dot is approximately equal to a threshold value.

* * * * *